United States Patent [19]

Rudny et al.

[11] 4,062,401

[45] Dec. 13, 1977

[54] TOROIDAL MULTIFLUID SEGMENTED HEAT EXCHANGER

[75] Inventors: Donald F. Rudny, Mundelein; Dennis H. Lindstedt, Libertyville, both of Ill.

[73] Assignee: International Harvester Company, Chicago, Ill.

[21] Appl. No.: 682,824

[22] Filed: May 3, 1976

[51] Int. Cl.[2] ..... F28F 13/12

[52] U.S. Cl. ..... 165/125; 165/140; 165/153; 123/41.49

[58] Field of Search ..... 165/140, 125, 153, 41; 123/41.11, 41.65, 41.33, 196 AB, 41.48, 41.49

[56] References Cited

U.S. PATENT DOCUMENTS

| | | | |
|---|---|---|---|
| 2,171,817 | 9/1939 | Wagner et al. | 165/140 X |
| 2,368,732 | 2/1945 | Wallgren | 165/125 X |
| 2,381,251 | 8/1945 | Belaieff | 165/153 X |
| 2,469,028 | 5/1949 | Belaieff | 165/153 |
| 2,662,748 | 12/1953 | Huber | 165/125 X |
| 3,759,321 | 9/1973 | Ares | 165/125 |
| 3,800,866 | 4/1974 | Ireland et al. | 165/125 UX |

FOREIGN PATENT DOCUMENTS

| | | | |
|---|---|---|---|
| 1,072,106 | 9/1954 | France | 165/125 |

*Primary Examiner*—Charles J. Myhre
*Assistant Examiner*—Ira S. Lazarus
*Attorney, Agent, or Firm*—Douglas W. Rudy; Floyd B. Harman

[57] ABSTRACT

A plurality of segmented components are arranged to form a fixed radial heat exchanger. Each segment is an independent heat exchanger having a core of fluid tubes and air flow corridors between the tubes. Air flow is maintained through the heat exchanger by means of a propeller type fan mounted coaxially with the heat exchanger.

4 Claims, 5 Drawing Figures

TOROIDAL MULTIFLUID SEGMENTED HEAT EXCHANGER

BACKGROUND OF THE INVENTION

1. Field of the Invention

A radial or toroidal heat exchanger for use on a vehicle having a plurality of segmented and independent heat exchanger components is provided.

2. Discussion of the Prior Art

Vehicles such as construction, agricultural, and earth-moving equipment are generally equipped with flat radiators to provide for the cooling of operating fluids. A propeller type fan is usually employed to force air flow through these flat radiators in a somewhat inefficient manner. Occasionally, these flat radiators are compartmentalized or stacked face-to-face to accommodate the cooling of several different vehicle fluids.

The inefficiency of the flat radiator is grounded in the ralationships between the propeller fan which scribes a circular arc and the flat radiator which is rectangular. There are always portions of the radiator which receive no directed air flow. This is sometimes alleviated through the use of fan shrouds which do help but air flow across the flat radiator remains less than ideal.

A recent patent, U.S. Pat. No. 3,800,866 to Ireland et al. (Apr. 2, 1974) presents an annular radiator that purports to alleviate some of the problems with the flat radiators. The annular radiator in that patent is multichambered with the chambers stacked annularly. Although this configuration may be an improvement over the prior art it none the less has shortcomings inherent in its design. For instance, ease of assembly, disassembly, substitution of cores and convertibility of cores are problems with the stacked annular radiator.

Also available in the prior art are rotary heat exchangers which are rapidly rotated such that the core itself generates air flow sufficient to enhance the heat exchange function. Although these units are quite efficient in operation they have heretofore unresolved fluid sealing problems that rule them out in widespread applications in vehicles.

SUMMARY OF THE INVENTION

A toroidal heat exchanger having a plurality of independent core sections arranged in a circular configuration is provided. Each individual core section is capable of providing the heat transfer means for one of the diverse vehicle operating fluids that require cooling on an implement hosting vehicle. Each core section is a complete functional heat exchanger while a plurality of heat exchangers are assembled together into the toroidal configuration to make up the entire unit.

Each heat exchanger core section includes an inlet header tank and an outlet header tank connected together by a plurality of fluid carrying conduits allowing flow from one tank to the other tank.

A fan will ordinarily be provided to either draw or force air flow through the heat exchanger.

One of the primary advantages of the toroidal heat exchanger proposed herein is that high efficiency of heat transfer can be attained for several different fluids by the use of a single air propelling fan in a single location.

Also an advantage of this invention is that there is an even air flow across the core area of each individual heat exchanger. Thus the efficiency of this system will normally be greater than the efficiency of conventionally stacked radiators.

Also an advantage of the proposed toroidal heat exchanger is that the entire assembly can be mounted in the location on the vehicle especially constructed for the heat exchanger environmental operation requirements with effective space utilization.

BRIEF DESCRIPTION OF THE DRAWINGS

These and other advantages and applications of the instant invention will be apparent from the following description when read in light of the drawing figures in which.

DETAIL DESCRIPTION OF THE DRAWINGS

In the figures like numerals have been assigned to like parts in the various projections.

Figure 1:
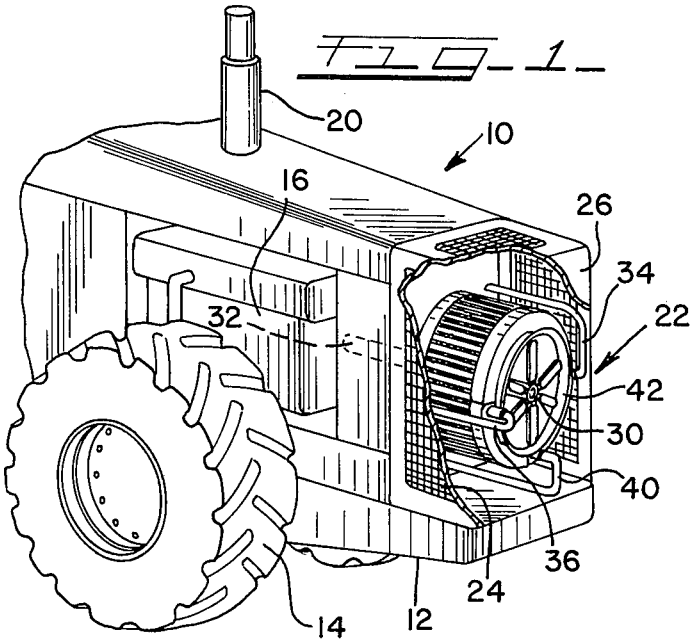
FIG. 1 presents a portion of a vehicle having broken away body panels showing the heat exchanger.

Looking at FIG. 1 there is presented a portion of a tractor type vehicle generally 10 supported by a frame 12 on a wheel and axle assembly 14.

The tractor vehicle used in the explanation of this embodiment will have, as a minimum, three fluid systems requiring cooling of the fluid. It may be convenient to think of the vehicle as a loader vehicle that uses hydraulically operated accessories and a fluid coupling transmission or torque converter. The representation of FIG. 1 could be envisioned as either the forward portion of a multiple drive axle vehicle or alternatively a rearward portion.

An engine 16 is carried in the frame 12 and is equipped with all the usual accessories such as an exhaust pipe and muffler 20. The toroidal heat exchanger of the invention is shown generally as 22. It is positioned at the extreme end of the vehicle 10 and is surrounded by ventilated body panels such as the side panel 24 which has been partially broken away to reveal the toroidal heat exchanger. Only a portion of an end plate 26, which would also be ventilated, is shown in FIG. 1.

The actual mechanism integral to the operation of the toroidal heat exchanger, generally 10 includes a fan 30 carried on and driven by a fan drive shaft 32 (broken line presentation in FIG. 1) from the engine 16 or another source of motion. A fan shroud 42 is also provided to optimize air flow to the system. A plurality of fluid supply conduits such as an engine coolant supply conduit 34, hydraulic fluid supply conduit 36 and transmission fluid supply conduit 40 is provided.

Figure 4:
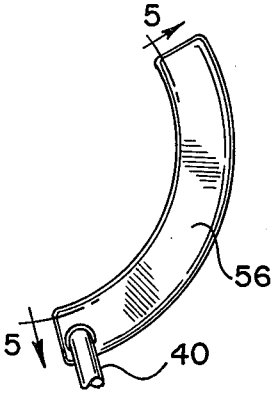
FIG. 4 is an elevation view of a single heat exchanger core shown separate from the assembled toroidal heat exchanger as shown in FIG. 2.
Figure 3:
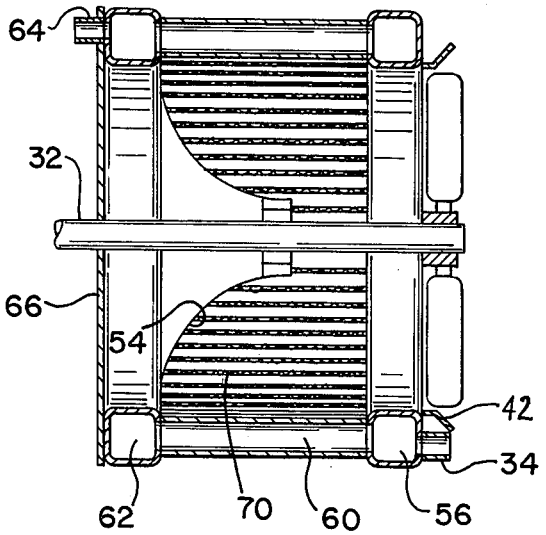
FIG. 3 is a cross sectional view taken through plane 3—3 of FIG. 2.
Figure 2:
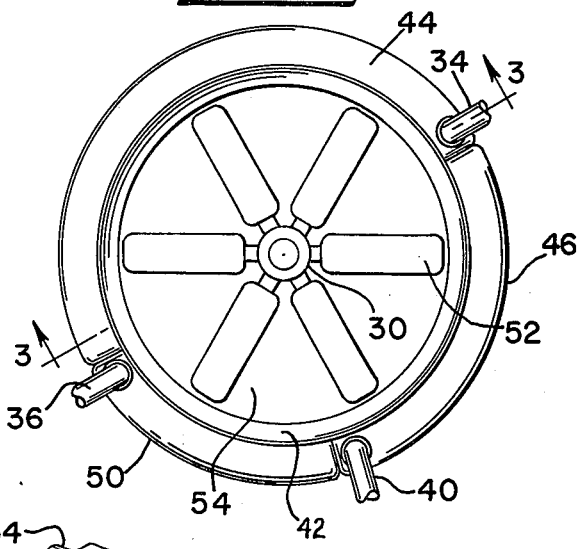
FIG. 2 presents an elevation view of the toroidal heat exhanger showing the independent heat exchanger core portions.

Directing the description to FIGS. 2, 3 and 4 it is to be seen that the toroidal heat exchanger is composed of several independent heat exchanger cores that have been arranged to form a short tube.

FIG. 2 shows an elevation view plainly conveying the structure. A first heat exchanger core 44, which may be used to effect heat transfer in the engine coolant, abuts the second heat exchanger core 46 which may be used as the cooling means for the transmission and torque converter fluid. A third heat exchanger core 50, providing for cooling the hydraulic fluid, may be interposed between the unabutted ends of the first and second heat exchanger cores, 44 and 46 respectively, such that the respective ends abut the first and second heat exchanger cores thus completing a full circle of heat exchanger cores.

Of course each heat exchanger core is formed with virtually identical radius dimensions such that the assembly will be toroidal when the various cores are placed together. The arcuate length of each heat exchanger core is determined by the heat load expected to be transferred by that particular core therefore in this particular embodiment it is apparent that the heat load imposed by the engine coolant is greater than the heat load imposed on the heat exchangers of the other fluids therefore the first heat exchanger core 44 is proportionally larger in capacity than the other two heat exchanger cores presented.

Also shown in FIG. 2 is the fan 30, including a plurality of fan blades 52, the flow improving fan shroud 42 and flow diverter 54. Each heat exchanger core is also provided with the supply conduit primarily referred to as the engine coolant supply conduit 34, the hyraulic fluid supply conduit 36 and the transmission fluid supply conduit 40. These supply conduits provide fluid ingress to the header tanks of each core which can be best seen in FIG. 3.

In FIG. 3, which is a cross sectional view taken from plane 3—3 of FIG. 2 an inlet side header tank 56 can be seen. In this case hot engine coolant will be supplied through the supply conduit 34 to the inlet header tank 56. From the inlet header tank 56 the engine coolant will pass through fluid carrying conduits 60 to the discharge header tanks 62. Fluid will then pass out of the discharge header tanks 62 via discharge port 64 and having been cooled to a sufficient degree, will pass by a conduit (not shown) back to the vehicle engine.

The inlet header tanks and the discharge header tanks are formed such that the major (longitudinal) axis is curved or arcuate. This is obvious from the various figures. Generally the curvature of the inlet header tank and the discharge header tank will be similar.

Also clearly shown in FIG. 3 are the fan drive shaft 32, the flow diverter 54 and a backing plate 66. The backing plate 66 may serve a dual purpose, that being to act as a rigid mounting plate to which the identical heat exchanger cores can be affixed and as a mounting plate that enables the entire toroidal heat exchanger to be mounted to the vehicle.

Figure 5:
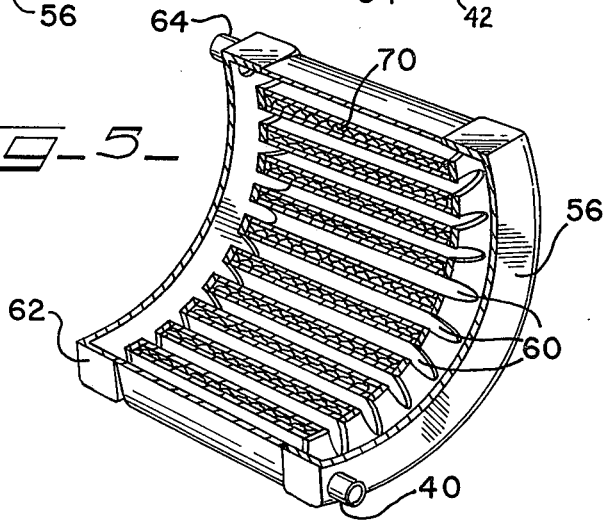
FIG. 5 presents a cross sectional view of the single heat exchanger core shown through plane 5—5 of FIG. 4.

FIGS. 4 and 5 are shown to present a cut-away view of a typical arcuate heat exchanger core. FIG. 4 shows the top of the inlet side header tank 56 and a typical supply conduit such as 40. In FIG. 5 the fluid carrying conduits, several delineated as 60, are shown between the inlet header tank 56 and the discharge header tank 62. As previously set forth fluid will enter through the supply conduit 40, pass from the inlet header tank 56 to the discharge header tank 62, through fluid carrying conduits 60, and finally out the discharge port 64. The size, spacing and quantity of fluid carrying conduits is optional and in an actual embodiment may be smaller than those fluid conduits shown as being relatively large to avoid confusion in FIG. 5.

The inclusion of a fan is apparent in the drawings. The direction of air flow generated by the fan could be outward through the air passages 70 or inward through the air passages. The preferred air flow direction would be the latter. However, this would generally be a matter of design preference.

Thus it is apparent that there has been provided a toroidal heat exchanger assembly having segmented component heat exchangers for effecting cooling of multiple and diverse fluids that fully satisfy the objects, aims, and advantages set forth above. While the invention has been described in conjunction with specific embodiments thereof it is evident that many alternatives, modifications and variations will be apparent to those skilled in the art in light of the foregoing description. For instance although the preferred embodiment has been recited as a toroidal heat exchanger having three component heat exchangers it would also be possible to provide a heat exchanger having either more than three or less than three heat exchanger components arranged in the arcuate and toroidal configuration shown in this invention. Accordingly, this disclosure is intended to embrace all such alternatives, modifications and variations as fall within the spirit and broad scope of the appended claims.

What is claimed is:

1. A toroidal heat exchanger comprising a plurality of arcuate heat exchanger cores, each for independently effecting the heat content of one of a plurality of vehicle related fluids, each arcuate heat exchanger core being one arcuate segment of said toroidal heat exchanger and each arcuate heat exchanger core having an arcuate inlet header tank and an arcuate outlet header tank connected by a plurality of liquid carrying conduits arranged parallel to the central axis of said toroidal heat exchanger, each arcuate heat exchanger core curved around said central axis of said toroidal heat exchanger further having said inlet and outlet header tanks located at the respective top and bottom of said toroidal heat exchanger.

2. A toroidal heat exchanger for use in effecting the transfer of heat energy from each of a plurality of said toroidal heat exchanger comprising:

a first arcuate heat exchanger core, being one arcuate segment of said toroidal heat exchanger, having an arcuate inlet header tank and an arcuate outlet header tank connected together by a plurality of fluid conduits arranged parallel to the central axis of said toroidal heat exchanger, said first arcuate heat exchanger core curved around said central axis further having said inlet and outlet header tanks located at the respective top and bottom of said toroidal heat exchanger;

a second arcuate heat exchanger core, being a second arcuate segment of said toroidal heat exchanger, having an arcuate inlet header tank and an arcuate outlet header tank connected together by a plurality of fluid conduits arranged parallel to the central axis of said toroidal heat exchanger, said second arcuate heat exchanger core curved around said central axis further having said inlet and outlet header tanks located at the respective top and bottom of said toroidal heat exchanger;

a third arcuate heat exchanger core, being a final segment of said toroidal heat exchanger, having an arcuate inlet header tank and an arcuate outlet header tank connected together by a plurality of fluid conduits arranged parallel to the central axis of said toroidal heat exchanger, said third arcuate heat exchanger core curved around said central axis further having said inlet and outlet header tanks located at the respective top and bottom of said toroidal heat exchanger whereby said first, second and third arcuate heat exchanger cores are arranged adjacent each other to form said toroidal heat exchanger.

3. The invention in accordance with claim 2 wherein said first arcuate heat exchanger core is an engine cooling fluid heat exchanger, said second arcuate heat exchanger core is a transmission and torque converter fluid cooler and said third arcuate heat exchanger core is a hydraulic fluid cooler.

4. A toroidal heat exchanger for use in effecting the heat content of a plurality of fluids, said toroidal heat exchanger comprising:

a plurality of arcuate heat exchanger cores each having an inlet header tank and an outlet header tank having respective integral inlet and outlet apertures, said inlet header tank connected to said outlet header tank through a plurality of fluid passages running parallel to the central axis of said toroidal heat exchanger separated by air passages, further said arcuate heat exchanger cores arranged end-to-end around said central axis whereby said toroidal heat exchanger is formed.

* * * * *